US011313539B2

(12) United States Patent
Santistevan

(10) Patent No.: US 11,313,539 B2
(45) Date of Patent: Apr. 26, 2022

(54) PERSONALIZED LIGHTING

(71) Applicant: Rain E. Santistevan, Austin, TX (US)

(72) Inventor: Rain E. Santistevan, Austin, TX (US)

( * ) Notice: Subject to any disclaimer, the term of this patent is extended or adjusted under 35 U.S.C. 154(b) by 0 days.

(21) Appl. No.: 17/344,716

(22) Filed: Jun. 10, 2021

(65) Prior Publication Data

US 2022/0090766 A1 Mar. 24, 2022

Related U.S. Application Data

(60) Provisional application No. 63/081,607, filed on Sep. 22, 2020.

(51) Int. Cl.

| | |
|---|---|
| ***F21V 17/00*** | (2006.01) |
| ***F21V 17/10*** | (2006.01) |
| ***F21V 15/01*** | (2006.01) |
| ***F21V 9/08*** | (2018.01) |

(52) U.S. Cl.
CPC ..... *F21V 17/002* (2013.01); *F21V 9/08* (2013.01); *F21V 15/01* (2013.01); *F21V 17/104* (2013.01)

(58) Field of Classification Search
CPC ..... F21V 17/002; F21V 9/08; F21V 15/01; F21V 17/1014
See application file for complete search history.

(56) References Cited

U.S. PATENT DOCUMENTS 7,588,343 B1 * 9/2009 Carter ..... E04C 3/36 362/152

* cited by examiner

*Primary Examiner* — Anabel Ton
(74) *Attorney, Agent, or Firm* — Blank Rome LLP

(57) ABSTRACT

A personalized lighting device includes a base, a first column, a second column, and a translucent colored panel. The first column includes a first end coupled to the base. The second column is spaced apart from the first column. The second column includes a first end coupled to the base. The translucent colored panel spans a space between the first column and the second column.

5 Claims, 7 Drawing Sheets

PERSONALIZED LIGHTING

CROSS-REFERENCE TO RELATED APPLICATIONS

The present application claims priority to U.S. Provisional Patent Application No. 63/081,607, filed Sep. 22, 2020, entitled "Personalized Lighting," which is hereby incorporated herein by reference in its entirety.

BACKGROUND

A lamp is a device that emits radiation in a predetermined band. For example, lamps that emit visible light are widely used to provide illumination in a variety of settings (e.g., educational settings, work settings, residential settings, etc.) The spectrum and intensity of visible light output by a lamp may be selected based on the setting in which the lamp is applied. For example, light spectrum and intensity may be selected to enhance productivity in a work or educational setting, or to enhance aesthetics in a more relaxed setting.

SUMMARY

In one example, a personalized lighting device includes a base, a first column, a second column, and a translucent colored panel. The first column includes a first end coupled to the base. The second column is spaced apart from the first column. The second column includes a first end coupled to the base. The translucent colored panel spans a space between the first column and the second column.

In another example, a personalized lighting device includes a first column, a second column, a third column, a fourth column, a first translucent colored panel, a second translucent colored panel, a third translucent colored panel, a fourth translucent colored panel, and a light source. The first translucent colored panel spans the first column and the second column. The second translucent colored panel spans the second column and the third column. The third translucent colored panel spans the third column and the fourth column. The fourth translucent colored panel spans the fourth column and the first column. The light source is configured to illuminate the first translucent colored panel, the second translucent colored panel, the third translucent colored panel, and the fourth translucent colored panel.

In a further example, a method for providing personalized lighting includes removing a cover from a plurality of columns. The cover is coupled to a first end of each of the plurality of columns. A first translucent colored panel is moved towards the first end of a first of the columns and a first end of the second of the columns, and moved out of a first slot of the first of the columns and a first slot of the second of the columns. A second translucent colored panel is moved into the first slot of the first of the columns and the first slot of the second of the columns, and moved towards a second end of the first of the columns and the second end of the second of the columns.

BRIEF DESCRIPTION OF THE DRAWINGS

For a detailed description of various examples, reference will now be made to the accompanying drawings in which.

DETAILED DESCRIPTION

Certain terms have been used throughout this description and claims to refer to particular system components. As one skilled in the art will appreciate, different parties may refer to a component by different names. This document does not intend to distinguish between components that differ in name but not in function. In this disclosure and claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections.

While a wide variety of lamps are available to meet the need for visual illumination, lamps directed to area illumination do not allow for personalization using art created or acquired by an owner or user of the lamp. The lamps disclosed herein include user replaceable panels. Translucent colored panels created or acquired by a user can be inserted into the frame of the lamp to create a new piece of art. For example, a user may create an artistic pattern of color on a clear translucent panel, and insert the panel into the frame of the lamp. Light produced within the lamp illuminates the panel to create a new piece of art.

Figure 1:
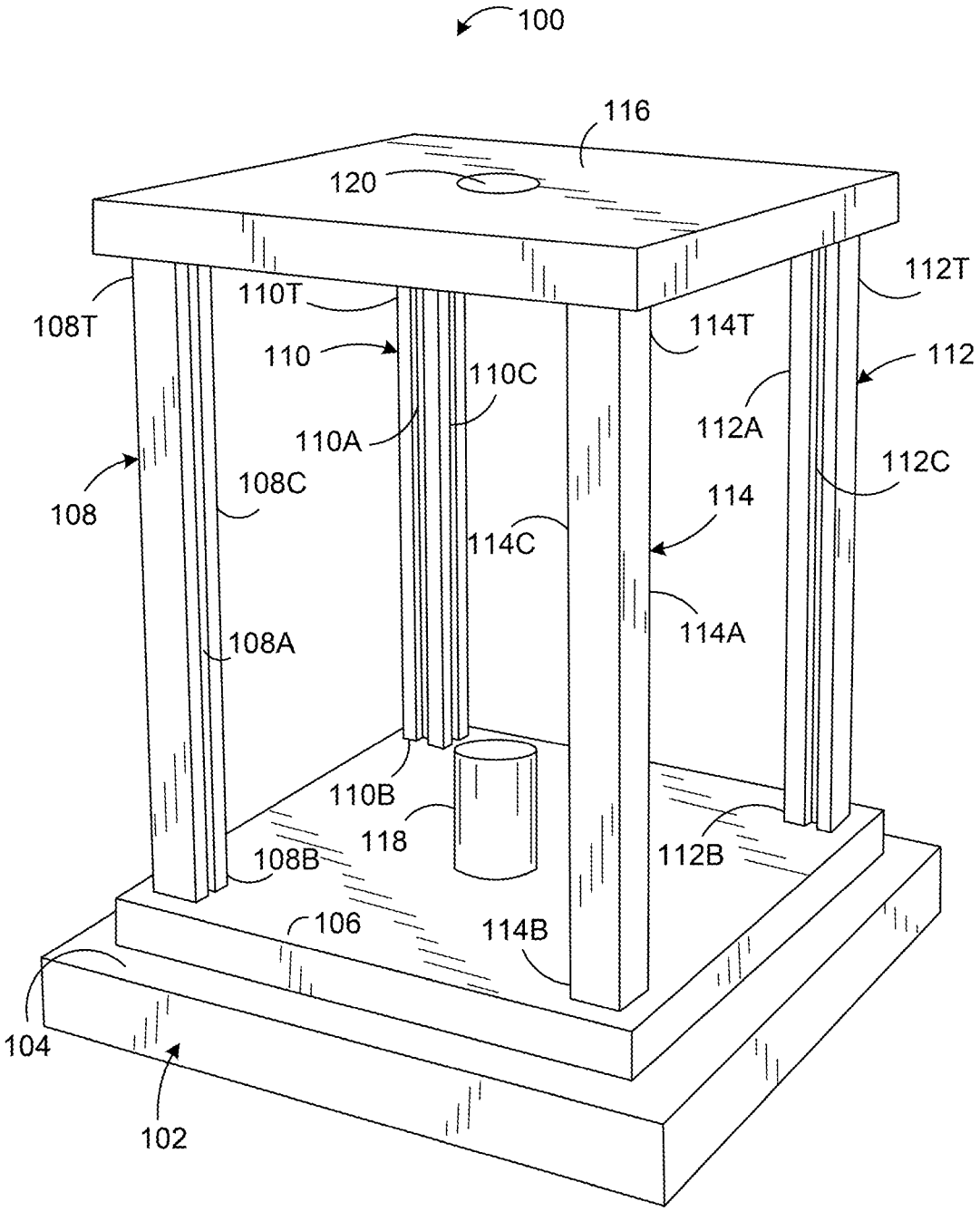
FIG. 1 shows perspective view of an example personalized lighting device as described herein.

FIG. 1 shows perspective view of personalized lighting device 100. The personalized lighting device 100 includes a base 102, columns 108, 110, 112, and 114, a cover 116, and a light source 118. The base 102 may include one or more layers. For example, as illustrated in FIG. 1, the personalized lighting device 100 includes a layer 104 and a layer 106, where the layer 106 is disposed on the layer 104. The columns 108, 110, 112, and 114 are coupled to the base 102.

Each column is spaced apart from each other column, and includes a first end (e.g., a bottom end) and a second end (e.g., a top end). The column 108 includes an end 1086 and an end 108T. The column 110 includes an end 1106 and an end 110T. The column 112 includes an end 112B and an end 112T. The column 114 includes an end 114B and an end 114T. The first end of each column is coupled to the base 102. For example, in FIG. 1, the end 108B of the column 108 is coupled to the base 102, the end 1106 of the column 110 is coupled to the base 102, the end 112B of the column 112 is coupled to the base 102, and the end 114B of the column 114 is coupled to the base 102. The second end of each column is coupled to the cover 116. For example, in FIG. 1, the end 108T of the column 108 is coupled to the base 102, the end 110T of the column 110 is coupled to the base 102, the end 112T of the column 112 is coupled to the base 102, and the end 114T of the column 114 is coupled to the base 102.

Each column also includes one or more slots for engaging and retaining an edge of a translucent panel. For example, in FIG. 1, each column includes two slots. The column 108 includes a slot 108A and a slot 108C. The column 110 includes a slot 110A and a slot 110C. The column 112 includes a slot 112A and a slot 112C. The column 114 includes a slot 114A and a slot 114C. Each slot extends from the first end of the column to the second end of the column. In the personalized lighting device 100, the slot 108C and the slot 110A engage a first panel, the slot 110C and the slot 112A engage a second panel, the slot 112C and the slot 114A engage a third panel, and the slot 114C and the slot 108A engage a fourth panel.

The light source 118 is coupled to the base 102 and is activated to illuminate the panels retained between the columns 108-114. The personalized lighting device 100 may include a switch and power conductors (not shown) to power and activate the light source 118. The light source 118 may include a light emitting diode, and incandescent bulb, or other light emitting device. A hole or passage 120 through the cover 116 (e.g., the center of the cover 116) allows light produced by the light source 118 to pass through the cover 116. The passage 120 may be circular, square, octagonal, or other shape, and may be, for example, about two inches in diameter in some implementations of the personalized lighting device 100.

The personalized lighting device 100 may be personalized by inserting translucent colored panels, created or acquired by a user, into the slots of the columns. Access to the slots, for removing panels currently in the personalized lighting device 100, and inserting new panels into the personalized lighting device 100, is obtained by removing the cover 116 from atop the columns 108-114. After the cover 116 is removed, the panels retained in the slots of the columns 108-114 may be removed by sliding the panels out of the slots. Thereafter, new panels are inserted into the slots of the columns 108-114 to personalize the personalized lighting device 100.

Figure 2:
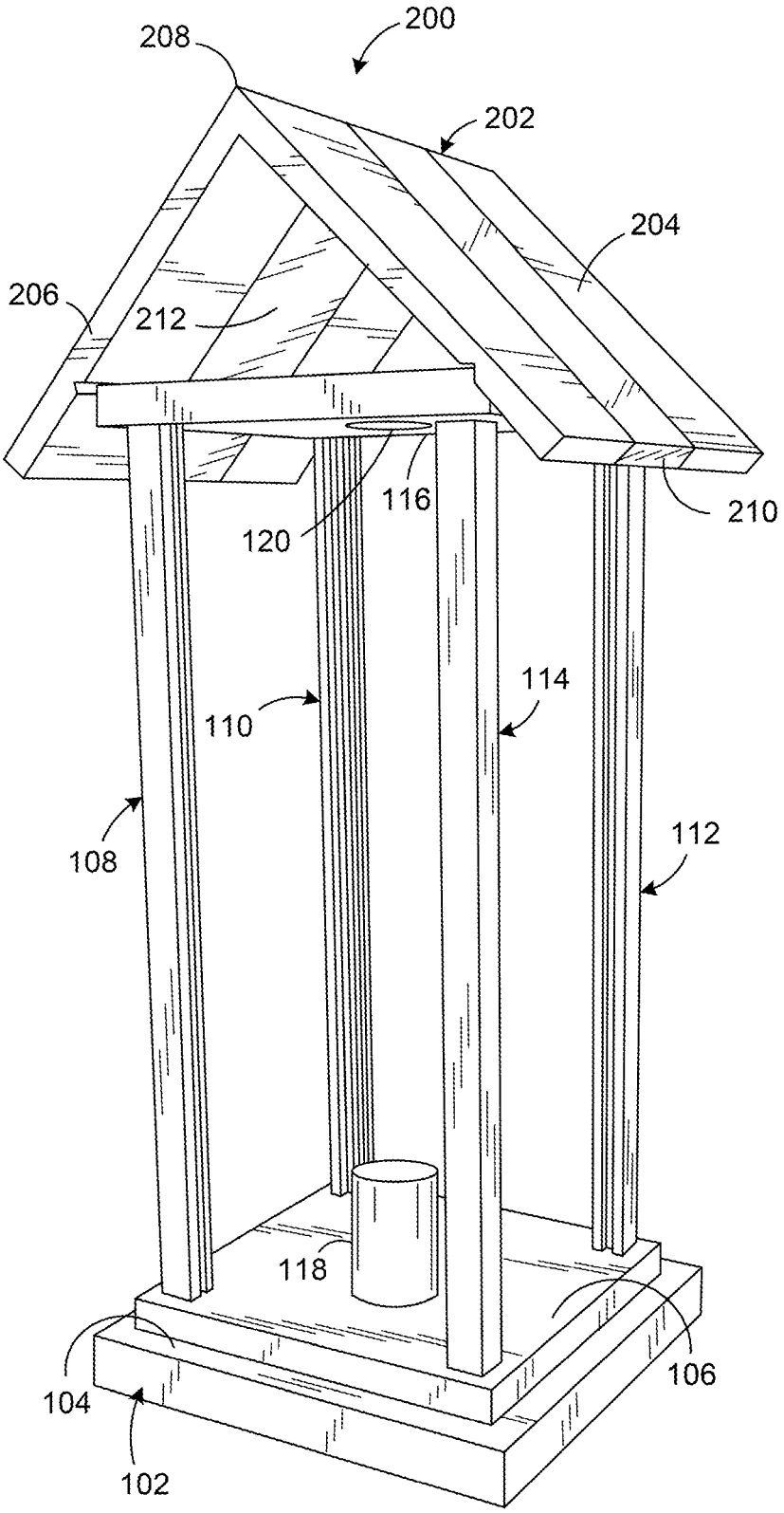
FIG. 2 shows a perspective view of an example personalized lighting device that includes a roof structure as described herein.

FIG. 2 shows a perspective view of a personalized lighting device 200. The personalized lighting device 200 is similar to (e.g., a implementation of) the personalized lighting device 100, and includes a roof structure 202. The roof structure 202 includes a roof section 204 and a roof section 206 that meet to form a ridge 208. The roof section 204 and the roof section 206 are coupled to the cover 116. In the personalized lighting device 200, the roof structure 202 is removed from (or installed on) the personalized lighting device 200, prior to or simultaneous to removal of (or installation of) the cover 116, to allow for replacement of the panels retained in the columns 108-114.

In some implementations of the roof structure 202, the roof section 204 may include a roof panel 210, and/or the roof section 206 may include a roof panel 212. The roof panels 210 and 212 may be transparent or translucent (e.g., a translucent roof panel). Light, generated by the light source 118, passes through the passage 120 of the cover 116 to illuminate the roof panels 210 and 212. The roof panels 210 and 212 may include ornamentation (e.g., ornamentation provided by a user) in some implementations of the personalized lighting device 200. The roof panels 210 and 212 may be centered in the roof section 204 and the roof section 206 respectively.

Figure 3:
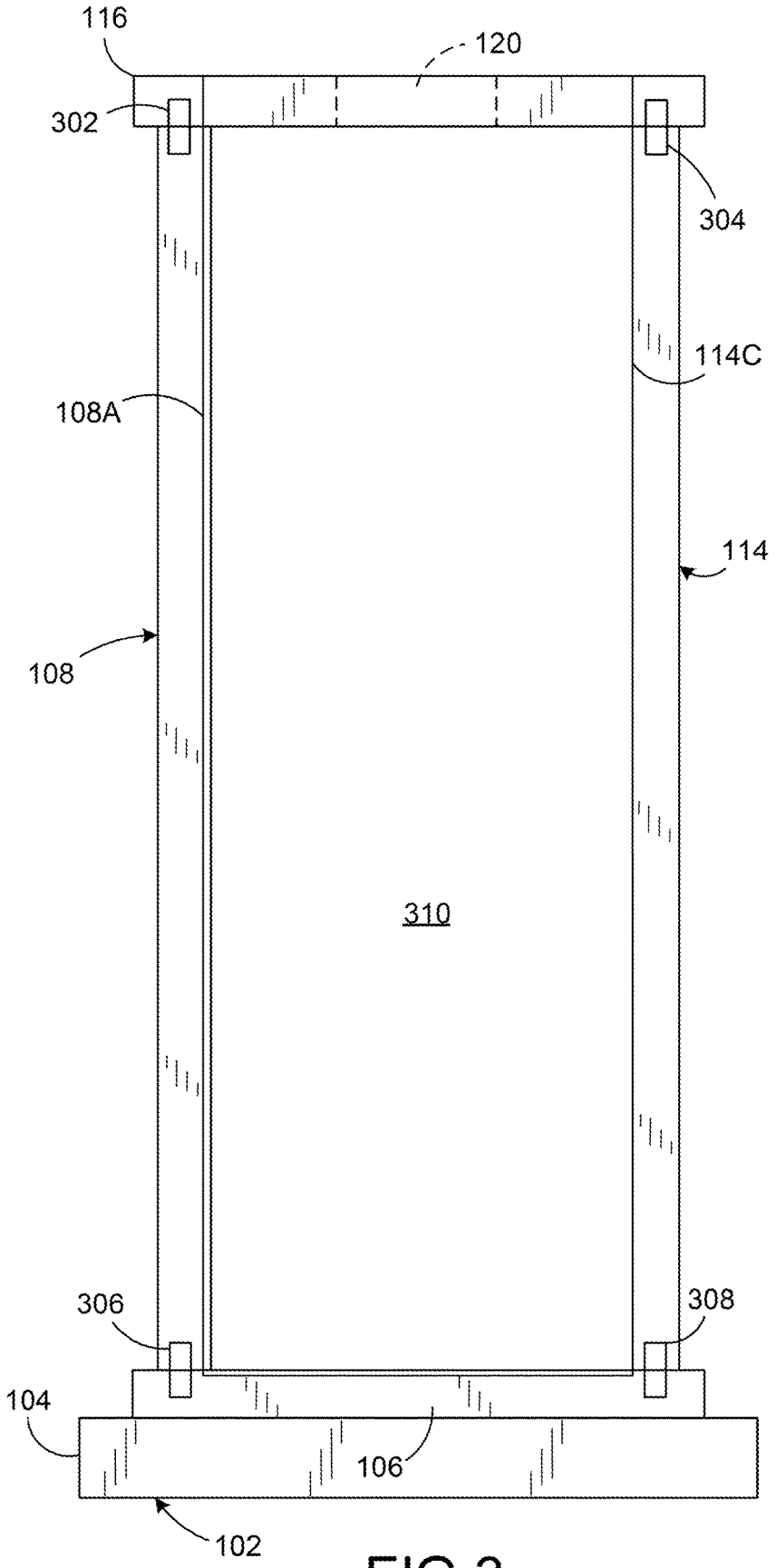
FIG. 3 shows an example of a translucent panel installed between two columns of a personalized lighting device as described herein.

FIG. 3 shows a translucent panel 310 installed between two columns of a personalized lighting device. In FIG. 3, columns 108 and column 114 are shown, and the translucent panel 310 engages the slot 108A of the column 108 and the slot 114C of the column 114. The slot 108A and the slot 114C are sized to securely retain the translucent panel 310. For example, if the translucent panel 310 is about ⅛ of an inch in thickness, then the slot 108A and the slot 114C may be about 3⁄16 of an inch in width. The slot 108A and the slot 114C may about 1⁄16 inches in depth.

Some implementations of the base 102 and the column 112 may also include a slot for engaging and retaining the translucent panel 310. Such a slot in the base 102 engages a bottom edge of the translucent panel 310, while such a slot in the cover 116 engages a top edge of the translucent panel 310. The width and depth of slots in the in the base 102 and column 112 may be the same as those of the slots in the columns 108, 114, etc.

Various retention mechanisms may be used to couple the columns to the base 102 and the cover 116. FIG. 3 shows the columns coupled to the base 102 and the cover 116 by dowels 302, 304, 306, and 308. The dowel 306 is friction fit in a hole in the end 108B of the column 108, and a hole in the base 102 to couple the column 108 to the base 102. Similarly, the dowel 308 is friction fit in a hole in the end 114B of the column 114, and a hole in the base 102 to couple the column 114 to the base 102. The dowel 302 is friction fit in a hole in the end 108T of the column 108, and a hole in the cover 116 to couple the column 108 to the cover 116. Similarly, the dowel 304 is friction fit in a hole in the end 114T of the column 114, and a hole in the cover 116 to couple the column 114 to the cover 116.

Figure 4:
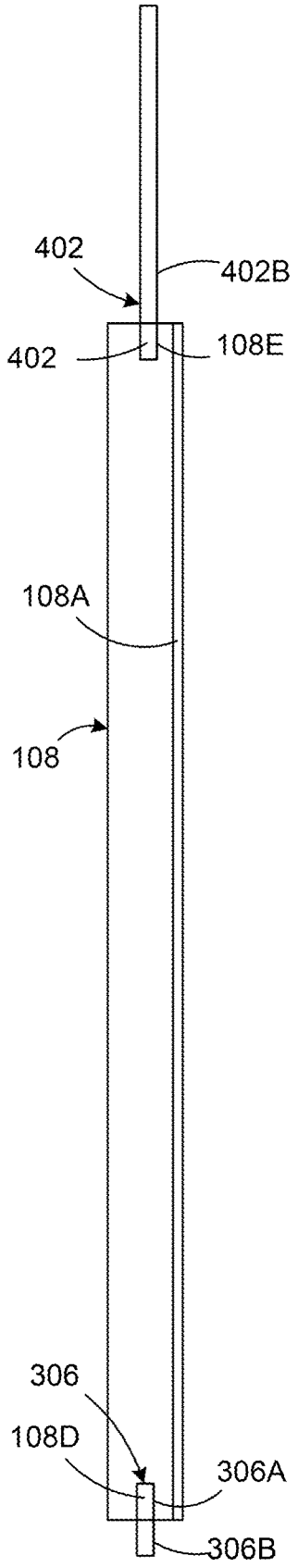
FIG. 4 shows an example of dowels coupled to a column of a personalized lighting device as described herein.

FIG. 4 shows dowels 306 and 402 coupled to the column 108 of a personalized lighting device as described herein. A segment 402A of the dowel 402 is friction fit into a socket 108E of the column 108. A segment 306A of the dowel 306 is friction fit into a socket 108D of the column 108. A segment 306B of the dowel 306 is to engage a socket of the base 102, and a segment 402B of the dowel 402 is to engage a socket or through hole of the cover 116 and/or the roof structure 202.

Figure 5:
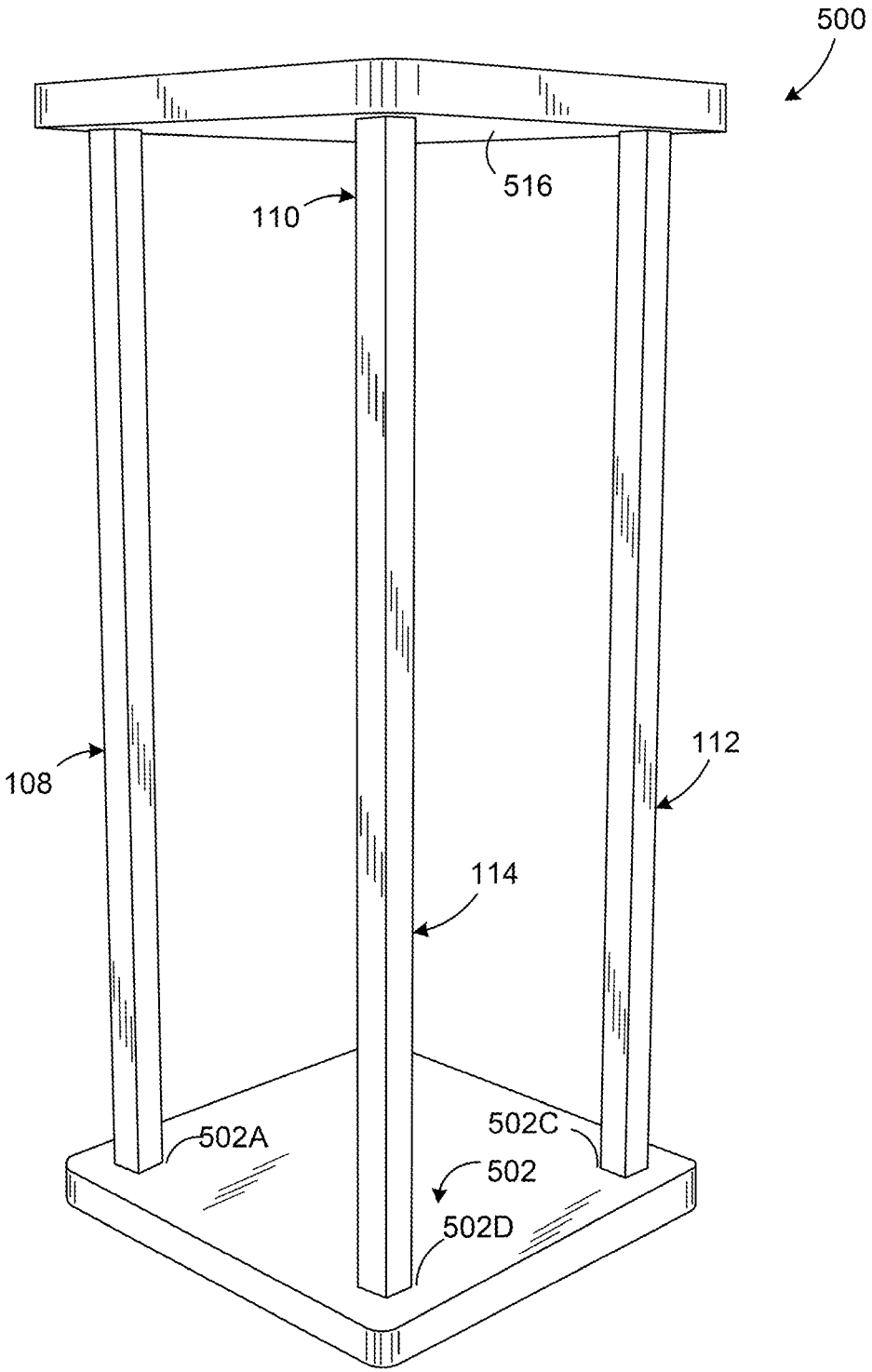
FIG. 5 shows an example of a personalized lighting device that includes sockets formed in the base and cover as described herein.

In another implementation of a personalized lighting device, the columns are friction fit into cavities/sockets formed in the base 102 and the cover 116. FIG. 5 shows an example personalized lighting device 500 that includes sockets formed in the base and cover as described herein. The personalized lighting device 500 includes a base 502, a cover 516, and the columns 108-114. The base 502 includes a socket for each of the columns. An end of each column is friction fit into the socket, such that the column is retained in the socket. In FIG. 5, sockets 502A, 502C, and 502D are shown. End 108B of the column 108 is friction fit into the socket 502A, end 112B of the column 112 is friction fit into the socket 502C, and end 1146 of the column 114 is friction fit into the socket 502D of the base 502. Though not shown in FIG. 5, the end 1106 of the column 110 is also friction fit into a socket of the base 502.

The cover 516 includes sockets corresponding to the sockets of the base 502, and an end of each column 108-114 is friction fit into a socket of the cover 516. For example, the end 108T of the column 108, the end 110T of the column 110, the end 112T of the column 112, and the end 114T of the column 114 are each friction fit into a socket of the cover 516.

Figure 6:
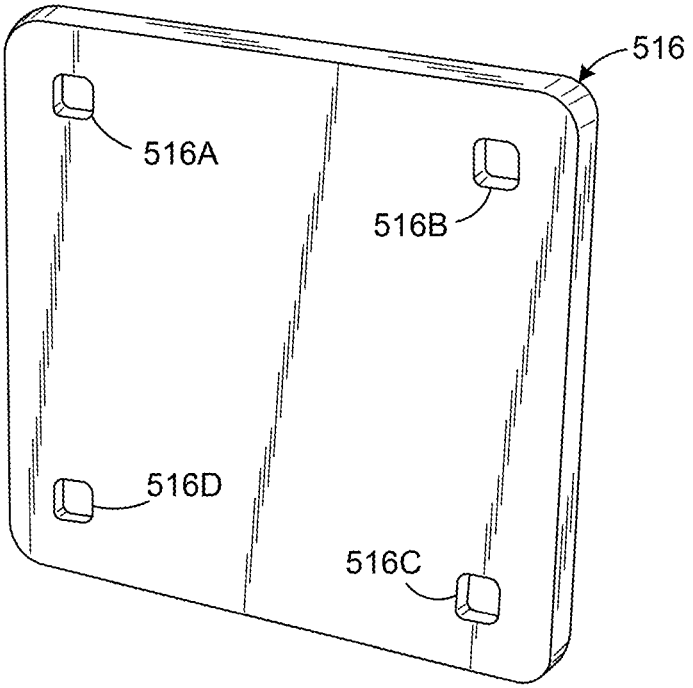
FIG. 6 shows an example of a base or cover that includes sockets for retaining the columns of a personalized lighting device as described herein.

FIG. 6 shows an example of the cover 516 (or the base 502) as described herein. The cover 516 is illustrated in FIG. 6, and the base 502 may be identical to the cover 516. The cover 516 includes sockets 516A, 516B, 516C, and 516D for engaging ends of the columns 108-114. For example, the end 108T of the column 108 is friction fit into the socket 516A of the cover 516, the end 110T of the column 110 is friction fit into the socket 516D of the cover 516, the end 112T of the column 112 is friction fit into the socket 516C of the cover 516, and the end 114T of the column 114 is friction fit into the socket 516B of the cover 516.

Other implementations of the personalized lighting device disclosed herein may use any of a variety of retention methods and devices to couple the columns to the base, the cover, or the roof structure. For example, nails, screws, adhesives, and/or other retention devices may be used to couple the columns to the base, cover, and/or roof structure in various implementations. In some implementations, hinges may be used to coupled to the columns to the roof structure.

Figure 7:
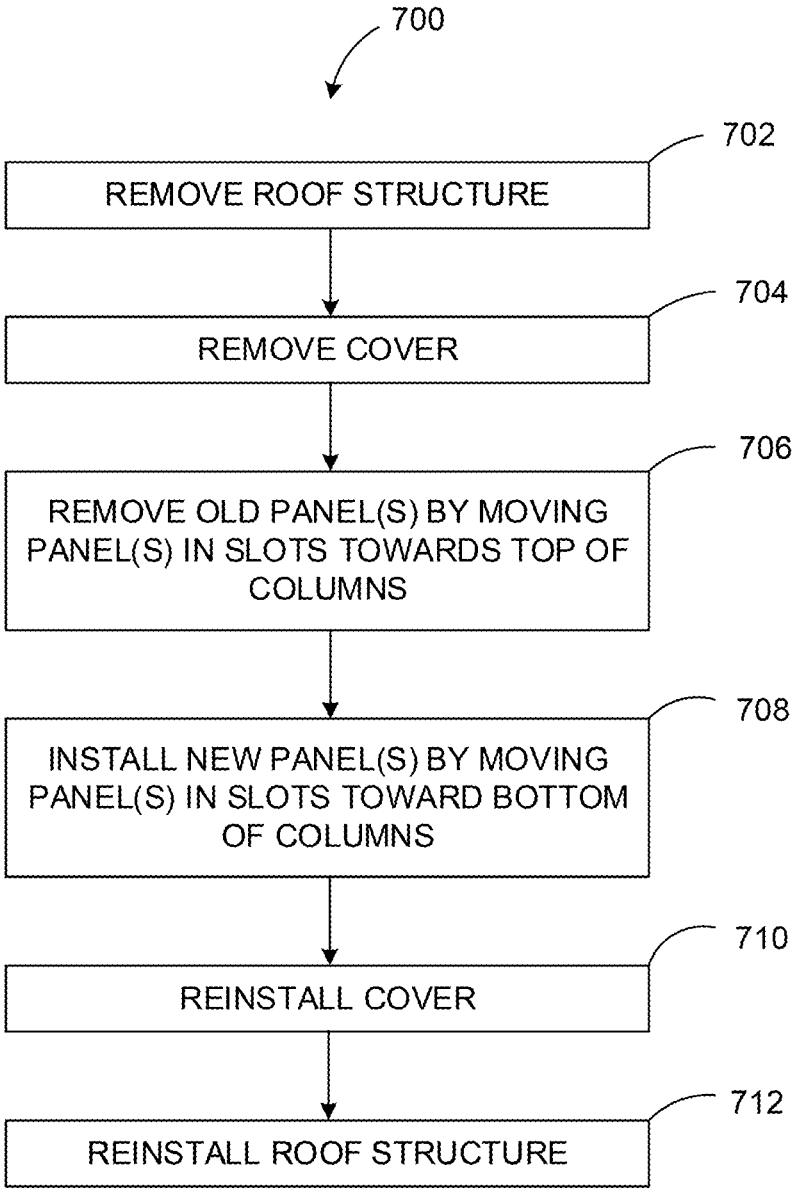
FIG. 7 shows a flow diagram for a method for providing personalized lighting as described herein.

FIG. 7 shows a flow diagram for a method 700 for providing personalized lighting as described herein. Though depicted sequentially as a matter of convenience, at least some of the actions shown can be performed in a different order and/or performed in parallel. Additionally, some implementations may perform only some of the actions shown. As part of the method 700, a user of the personalized lighting device (e.g., the personalized lighting device 200), may create or acquire translucent colored panels to be installed in a personalized lighting device, such as the personalized lighting device 200. The method 700 is described with reference to the personalized lighting device 200, but is applicable to other implementations of the personalized lighting device described herein.

In block 702, the roof structure 202 is removed from the personalized lighting device 200. For example, the roof structure 202 is removed from atop the cover 116.

In block 704, the cover 116 is removed from the personalized lighting device 200. For example, the cover 116 is removed from atop the columns 108-114.

In block 706, the translucent colored panels currently installed in the personalized lighting device 200 are removed. Removal of a panel includes sliding the panel towards the top of the columns retaining the panel and out of the slots engaging the edges of the panel. For example, a panel retained between the columns 108 and 114 is removed by sliding the panel towards the end 108T of the column 108 and the end 114T of the column 114, and out of the slot 108A and the slot 114C.

In block 708, translucent colored panels (e.g., new/different/updated/changed translucent colored panels) are installed in the personalized lighting device 200. Installation of the panels includes engaging edges of the panels in the slots of the columns that are to retain the panel, and sliding the panel towards the bottom of the columns. For example, a panel is installed between the columns 108 and 114 by engaging opposing side edges of the panel in the slot 108A of the column 108 and the slot 114C of the column 114, and sliding the panel towards the end 108B of the column 108 and the end 114B of the column 114.

In block 710, after installation of the translucent colored panels in block 708, the cover 116 is reinstalled atop the columns 108-114.

In block 712, the roof structure 202 is installed atop the cover 116.

The light source 118 is activated to illuminate the panels installed in the personalized lighting device 200 (e.g., the panels installed in block 708).

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A personalized lighting device, comprising:
a first column comprising a first end;
a second column comprising a first end,
a third column comprising a first end,
a fourth column comprising a first end;
a first translucent colored panel spanning the first column and the second column;
a second translucent colored panel spanning the second column and the third column;
a third translucent colored panel spanning the third column and the fourth column;
a fourth translucent colored panel spanning the fourth column and the first column; and
a light source configured to illuminate the first translucent colored panel, the second translucent colored panel, the third translucent colored panel, and the fourth translucent colored panel;
a cover coupled to the first end of the first column, the first end of the second column, the first end of the third column, and the first end of the fourth column; and
a roof structure coupled to the cover, and including a translucent roof panel;
wherein the cover includes a passage configured to pass light from the light source to the roof structure to illuminate the translucent roof panel.

2. The personalized lighting device of claim 1, wherein:
the first column comprises a second end;
the second column comprises a second end;
the third column comprises a second end;
the fourth column comprises a second end; and
the personalized lighting device comprises a base coupled to the second end of the first column, the second end of the second column, the second end of the third column, and the second end of the fourth column.

3. The personalized lighting device of claim 1, wherein:
the first column comprises:
a first slot configured to engage a first edge of the first translucent colored panel; and
the second column comprises:
a first slot configured to engage a first edge of the first translucent colored panel; and
a second slot configured to engage a first edge of the second translucent colored panel; and
the third column comprises:
a first slot configured to engage a second edge of the second translucent colored panel.

4. The personalized lighting device of claim 3, wherein:
the third column comprises:
a second slot configured to engage a first edge of the third translucent colored panel; and
the fourth column comprises:
a first slot configured to engage a second edge of the third translucent colored panel.

5. The personalized lighting device of claim 4, wherein:
the fourth column comprises:
a second slot configured to engage a first edge of the fourth translucent colored panel; and
the first column comprises:
a second slot configured to engage a second edge of the fourth translucent colored panel.

* * * * *